US005816320A

United States Patent [19]

Arnold et al.

[11] Patent Number: 5,816,320

[45] Date of Patent: Oct. 6, 1998

[54] RADIATOR FIN CONSTRUCTION

[75] Inventors: Allen W. Arnold; Patti A. Arnold; Louie L. Pratt, all of Midway City, Calif.

[73] Assignee: J.I.T. Engineering, Inc., Visalia, Calif.

[21] Appl. No.: 781,870

[22] Filed: Jan. 10, 1997

[51] Int. Cl.[6] ..... F28D 1/02

[52] U.S. Cl. ..... 165/152; 165/181; 165/153

[58] Field of Search ..... 165/153, 152, 165/181

[56] References Cited

U.S. PATENT DOCUMENTS

| | | | |
|---|---|---|---|
| 1,950,500 | 3/1934 | Lorpich et al. | 165/153 |
| 2,063,757 | 12/1936 | Saunders | 165/153 |
| 2,133,502 | 10/1938 | Emmons | 165/153 |
| 2,573,161 | 10/1951 | Tadewald | 165/153 |
| 2,647,731 | 8/1953 | Ludlow | 165/152 |
| 2,843,365 | 7/1958 | Getz | 165/153 |
| 2,848,200 | 8/1958 | Jacobs | 165/152 |
| 4,379,486 | 4/1983 | Kurihara | 165/153 |
| 4,469,168 | 9/1984 | Itoh et al. | 165/153 X |

*Primary Examiner*—Ira S. Lazarus
*Assistant Examiner*—Christopher Atkinson

[57] ABSTRACT

A fin for a radiator for cooling a fluid, the fin being made from a thin sheet of heat-conductive metal. The fin has many stacked fin elements formed from a single sheet. While the typical radiator fin is formed in a serpentine shape with rounded edges, the fin of the present invention is formed so it has flat edges. This facilitates the attachment of the fin to the tubes and also increases the minimum spacing between the cross-elements of the fin so that the fin is less apt to plug up in addition to being stronger as a result of a large flat bonding area against the tubes.

8 Claims, 2 Drawing Sheets

RADIATOR FIN CONSTRUCTION

BACKGROUND OF THE INVENTION

The field of the invention is heat transfer devices and the invention is especially useful for radiators used in motor vehicles although it has application in other heat exchange applications.

A classic motor vehicle radiator construction is shown generally in U.S. Pat. No. 4,377,024 where flattened tubes 15 are held between two header plates wherein upper and lower tanks 55 and 56 are affixed over the header plates and a liquid to be cooled is passed in and out of these tanks. The fins 18 are bent from a thin sheet of copper or aluminum and are braised, soldered or otherwise held at their rounded ends to tubes 15. While such construction is generally satisfactory, the fins have a relatively weak bond because of the small surface at the end of each curved portion of the fin and the tubes. In some motor vehicle or other motorized devices the radiator is subjected to substantial shock such as, for instance, in a cement truck. In such high stress environments the fins can separate from the tubes, thereby greatly reducing the transfer of heat between the tubes and the fins as well as the strength of the radiator assembly. Furthermore, because the fins are quite narrow at each bent end adjacent the curved portion, these parts can easily be plugged with dirt, insects and other debris which further reduces the flow of air through the radiator. This can substantially decrease the radiator's cooling capacity. Sometimes louvers are formed on the surface of the serpentine fins which further reduces the area between adjacent bends of the fins.

While the present invention has its greatest use for the cooling of a liquid coolant in a gasoline or diesel engine, it is, of course, generally a heat exchanger and various constructions of heat exchangers have been formed of many different shapes. U.S. Pat. No. 4,606,495 shows a fin/plate heat exchanger having a U-shaped cross-section braised to two flat plates 3. U.S. Pat. No. 4,881,311 shows a serpentine fin held by slots over a tube such as that utilized in an air conditioner evaporator. U.S. Pat. No. 5,077,889 shows a thermistor which has a serpentine set of fins on each side of the thermistor which may also be a square U-shaped fin, such as shown in FIG. 5B. A motor vehicle radiator is shown in U.S. Pat. No. 5,295,302 where fins are placed within the flat tubes to improve the transfer of heat from the liquid within the tube to the outer wall of the tube.

SUMMARY OF THE INVENTION

It is an object of the present invention to provide a fin construction for a radiator which is more strongly bonded to the tubes of the radiator and also has a lower tendency for air flow past the fins to become reduced by fouling.

DESCRIPTION OF THE PREFERRED EMBODIMENTS

Figure 1:
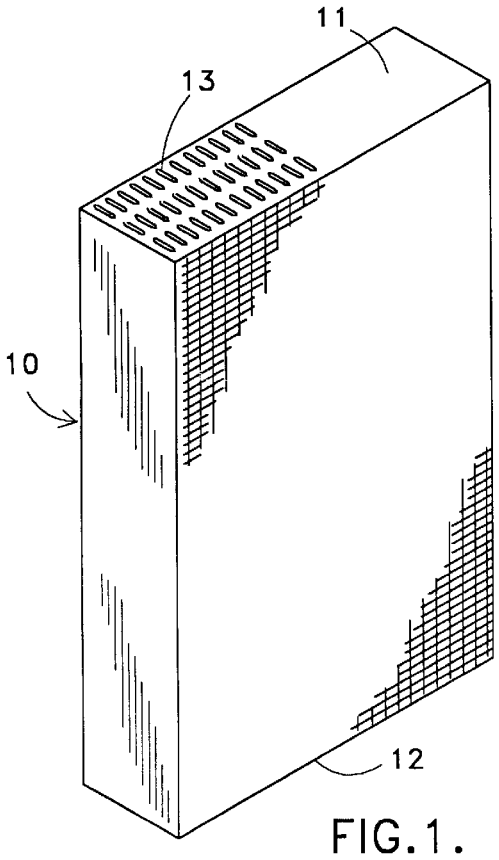
FIG. 1 is a diagrammatic perspective view of the core of a radiator of the type commonly used with motor vehicles.

A radiator is shown in diagrammatic and perspective view in FIG. 1 and indicated generally by reference character 10. Radiator 10 has a top header 11 and a bottom header 12. A series of coolant containing tubes 13 extends through the top and bottom headers in a conventional manner and a tank is typically soldered over the top header 11 and under the bottom header 12. Coolant may be passed into and out of the tanks and through the tubes 13. The hoses and support structure used with the radiator of the present invention is not shown since they are conventional.

While the tubes are shown oriented in a vertical direction in the drawings, it is, of course, understood that the radiator can function in any orientation and the tubes can be turned so that they are horizontal and the fins generally vertical or in any orientation. The reference to the tubes as vertical is used for facilitating the description of the relative alignment of the tubes and fins and is not intended to limit the fins of the present invention to any particular orientation.

Figure 2:
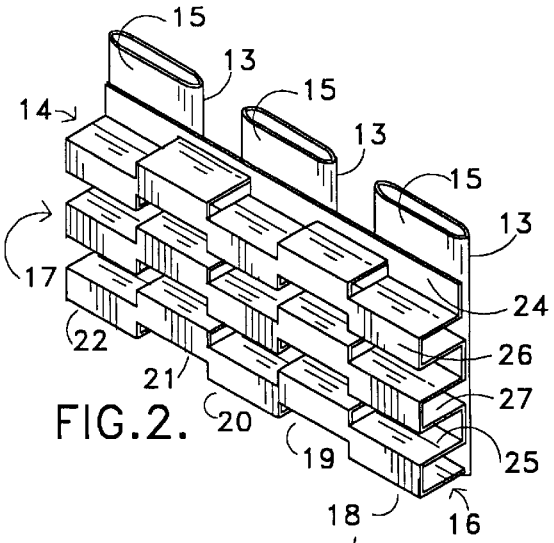
FIG. 2 is an enlarged broken away perspective view of a portion of the radiator of FIG. 1.

Radiator 10 has a fin assembly 14 which is shown in perspective view in FIG. 2. Fin assembly 14 is soldered to the flat sides 15 of coolant containing tubes 13. Fin assembly 14 is formed from a thin flat sheet of copper, aluminum or other metal or metal alloy having excellent heat transfer characteristics and the ability to be soldered or braised or otherwise connected in a heat transfer relationship with flat tubes 13. Fin assembly 14 when bent and cut into the shape shown in FIG. 2 has a forward edge 16 and a rearward edge 17. The particular configuration shown in FIG. 2 has five sets of stacked integral fin elements indicated by reference characters 18, 19, 20, 21, and 22. The second tube attached length 26 of the first set 18 of stacked integral fin elements is integrated with the second tube attached length 26 of the second set 19 of stacked integral fin elements. This increases the fin strength and facilitates the insertion of the fin assembly 14 between the tubes 13.

Figure 3:
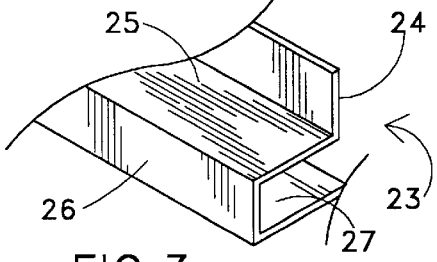
FIG. 3 is a further broken away portion of the radiator of FIG. 1.

A single fin element 23 is shown in FIG. 3 and it can be understood that stack 18 is made up of a plurality of such fin elements. Fin element 23 has a first tube attached length 24, a first cross length 25, a second tube attached length 26 and a second cross length 27. As readily seen in FIGS. 2 and 3, first and second tube attached lengths 24 and 26 are generally flat which provide a large area for soldering or otherwise bonding the sides to the flat sides 15 of tubes 13. This has several distinct advantages: First, it provides a physically strong bond since there is a large area both of flat tube and of fin surface touching each other. Secondly, it provides a large area of contact to assist in the flow of heat out from flat side 15 into fin assembly 14.

Figure 4:
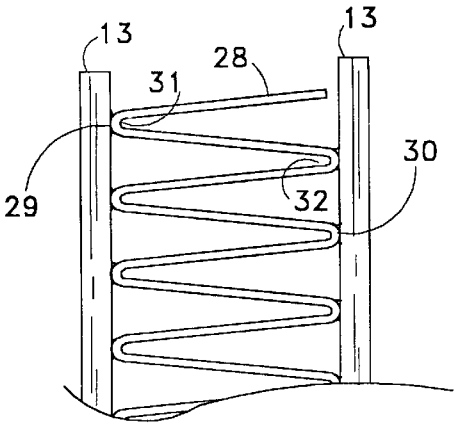
PRIOR ART FIG.4.
FIG. 4 is a front view of a portion of a prior art radiator similar to that shown in FIG. 1.
Figure 5:
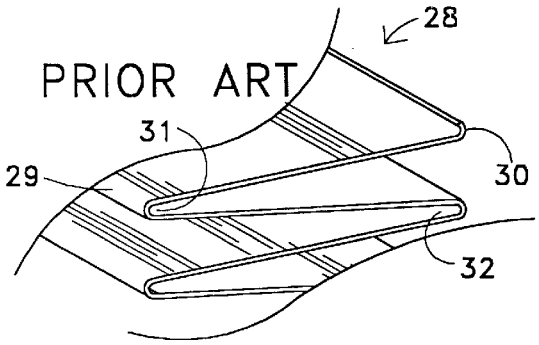
FIG. 5 is an enlarged perspective view of a portion of the prior art radiator of FIG. 4.

A third advantage of the construction of FIG. 2 can be understood by a comparison of the prior art construction shown in FIGS. 4 and 5 with the new construction shown in FIGS. 2 and 3. A prior art portion of a radiator is shown in FIG. 4 and the coolant containing flat tubes 13 are identical to those shown in FIGS. 1 and 2. A serpentine fin, made from a thin flat sheet is indicated by reference character 28. Serpentine fin 28 is soldered at each round end 29 and 30 to the flat sides of tubes 13. This creates two very thin areas 31 and 32 which are more prone to be plugged by dirt and debris than are the wider areas of the fin of the present invention.

Figure 6:
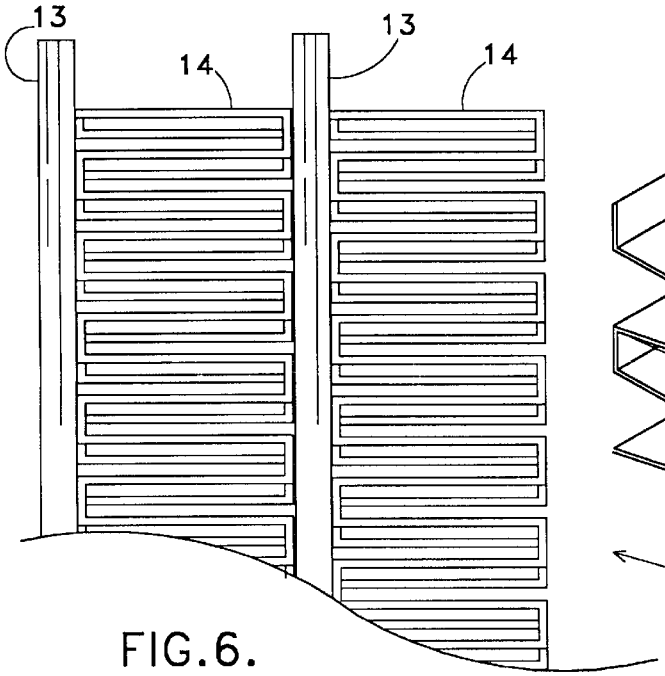
FIG. 6 is a front view of a portion of the improved radiator of FIG. 1.

The use of flat tube attaching lengths such as those indicated by reference characters 24 and 26 in FIG. 3 permits yet another significant design improvement. This improvement relates to cooling capacity and is shown in FIG. 2. This improvement is the offsetting of the sets of stacked integral fin elements. As shown in FIG. 6, this construction of offset stacks continuously splits an air stream in two. With this construction the portion of the air stream which was the coolest is suddenly contacted with a fresh edge. This continuous air stream splitting increases the temperature difference between the air stream and the fin, improving the flow of heat out of the fin into the air stream.

Figure 7:
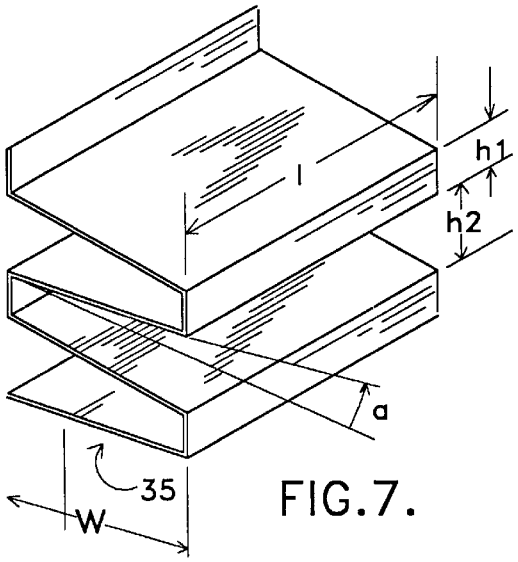
FIG. 7 is a perspective view of an alternate embodiment of the fin of the radiator of FIG. 1.

While the construction shown in FIGS. 2 and 6 show generally horizontal cross links 25 and 27, the advantages of the construction of the fins of the present invention can also be accomplished with a slight angled cross link such as shown in FIG. 7. This stack is indicated by reference character 35. In the bending process the elasticity of the metal will tend to alter the preferred horizontal position to the angled position of FIG. 7. This angle, indicated by reference character "a" in FIG. 7, should not exceed about 5 degrees and is preferably no more than about 2.5 degrees. A typical set of integral fin elements such as set 18 has a width "w" of about ¼", a length "l" of about ½" and a flat height "h1" of about 1/10" and a spacing between adjacent flat tube attaching links "h2" of 0.15". The ratio of the flat height h2 to the width should be between 25% and 50% with about 40% being ideal. The thin metal thickness is conventional being typically 3 mils although fin thickness varies from 2 to 7 mils.

Figure 8:
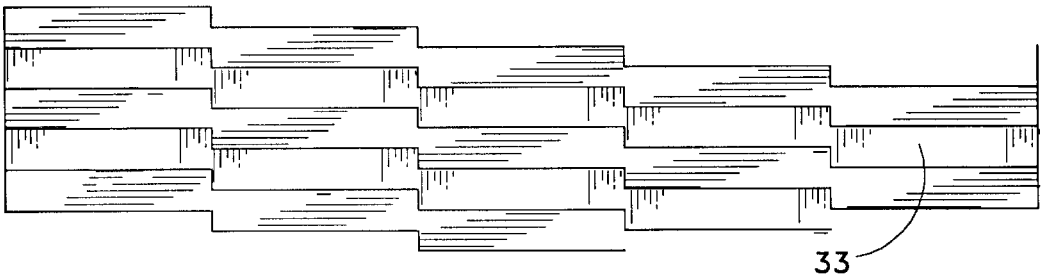
FIG. 8 is a side view of an alternate embodiment of the fin of the radiator of FIG. 1.
Figure 9:
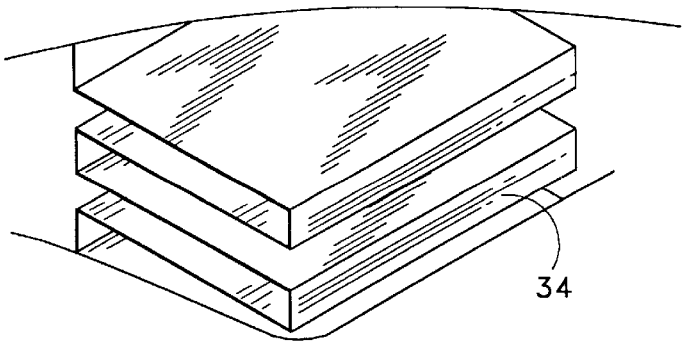
FIG. 9 is a perspective view of an alternate embodiment of the fin of the radiator of FIG. 1.

While a staggered configuration is preferred and is shown in FIG. 2, the configuration could as well be a continuously stepped configuration such as shown in FIG. 8 where the fin portion is indicated by reference character 33. While the stepped configuration shown in FIGS. 2 and 8 are preferred for maximizing heat transfer, the unstepped configuration of FIG. 9 can be used where a maximum protection against plugging is accomplished together with high strength. The heat transfer capability is significantly reduced without the continuously stepped or staggered feature. The fin element of FIG. 9 is indicated by reference character 34.

The fins of the present invention can be economically fabricated. It is preferred that there be at least three sets of stacked fin elements and five fin elements are generally ideal. The preferred offset between adjacent stacks is one-half the distance of the tube attachment height. In this way the adjacent fins exactly bi-sect the air flow from the upstream fins. It has been found that a very strong and efficient motor vehicle radiator results from a tube attachment length of about 1/10" and a width of each cross link of about ¼". A width of each stacked fin element of about ½" has also provided an excellent combination of strength and heat transfer capability. It has been determined that the strength of a radiator using the fins of the present invention is so strong that corner reinforcement is not needed.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A fin for transferring heat into an air stream and for strengthening a heat exchanger to which it is bonded, said fin being fabricated from a length of a thin sheet of metal having a first side, a second side, an upstream edge, a downstream edge, said thin sheet being cut and bent to form a formed fin, said formed fin comprising:

a first plurality of stacked fin elements, each fin element having a first generally flat first tube attachable length, a first cross length, a second generally flat second tube attachable length, a second cross length, each tube attachable length and each cross length being formed at about a right angle to each other; and a second plurality of stacked fin elements, each fin element having a generally flat first tube attachable length, a first cross length, a generally flat second tube attachable length, a second cross length, each tube attachable length and each cross length being formed at about a right angle to each other and said second plurality of stacked fin elements being offset so that each cross length of said second plurality of stacked fin elements lies equidistant between each cross length of said first plurality of stacked fin elements and each first generally flat tube attachable length of a first plurality of stacked fin elements being integral with the adjacent first generally flat tube attachable length of a second plurality of stacked fin elements.

2. The fin of claim 1 wherein said thin sheet is fabricated from a copper alloy.

3. The fin of claim 1 wherein said thin sheet is fabricated from an aluminum alloy.

4. The fin of claim 1 wherein the height of each tube attachable length is about forty per cent of the width of each cross length.

5. The fin of claim 4 wherein the height of each tube attachable length is about one tenth of an inch and the width of each cross length is about one quarter of an inch.

6. The fin of claim 1 further including a third plurality of stacked fin elements.

7. The fin of claim 1 further including a third, fourth, and a fifth plurality of stacked fin elements.

8. The fin of claim 1 wherein each plurality of stacked fin elements is about one-half inch in width.

* * * * *